United States Patent [19]

Wenthe

[11] 4,127,263

[45] Nov. 28, 1978

[54] PORT-CLOSURE FOR VACUUM SHEET FEEDER

[75] Inventor: Stephen J. Wenthe, Rochester, N.Y.

[73] Assignee: Eastman Kodak Company, Rochester, N.Y.

[21] Appl. No.: 810,259

[22] Filed: Jun. 27, 1977

[51] Int. Cl.[2] ..... B65H 3/12

[52] U.S. Cl. ..... 271/96; 271/99; 271/108; 271/112

[58] Field of Search ..... 271/96, 94, 95, 108, 271/99, 112

[56] References Cited

U.S. PATENT DOCUMENTS

| | | | |
|---|---|---|---|
| 2,085,592 | 6/1937 | Koppe | 271/95 |
| 3,291,482 | 12/1966 | Stemmler | 271/94 X |

*Primary Examiner*—Richard A. Schacher

*Attorney, Agent, or Firm*—Lawrence P. Kessler

[57] ABSTRACT

Vacuum feeder for feeding sheets having holes adjacent to a marginal edge of the sheets. Removable port-closure members are inserted through and close the feeder ports which are aligned with the holes in the sheets to be transported by the feeder.

3 Claims, 3 Drawing Figures

PORT-CLOSURE FOR VACUUM SHEET FEEDER

BACKGROUND OF THE INVENTION

1. Field of the Invention

This invention relates generally to a sheet feeding method and apparatus, and more particularly to means for closing selected ports of a vacuum sheet feed apparatus.

2. Description of the Prior Art

In modern reproduction equipment such as printing presses or copier/duplicators, copies are generally made on discrete copy sheets. The sheets are fed seriatim, either mechanically or pneumatically, from a supply along a transport path to a printing station where an ink or toner image is placed on the sheets. One type of pneumatic feeder which has been adapted for use in such reproduction equipment is a rotating vacuum feeder as shown in U.S. Pat. No. 2,770,458 issued Aug. 14, 1953, in the name of Halahan, et al. Such a vacuum feeder has a series of ports in the wall of a rotating tubular housing, the ports being spaced in axial alignment along the housing transverse to the sheet travel path. A vacuum source connected to the interior of the housing creates a sub-atmospheric pressure condition in the area of the ports. The housing is rotated to locate the ports adjacent to a supply stack of discrete sheets where the vacuum causes the portion of a sheet opposite the ports to be stripped from the stack and tacked to the housing. As the housing is rotated from this position, the tacked sheet is drawn from the stack and fed along the transport path. While such an arrangement is generally satisfactory for efficient feeding of discrete sheets, misfeeds or objectional multiple sheet feeds may occur if the sheets have holes which are aligned with the ports in the housing during transport. Sheets upon which it is often desired to make copies include, for example, 3-hole and 7-hole punched paper.

SUMMARY OF THE INVENTION

In accordance with the present invention selected ports of a vacuum feeder are closed to enable the feeder to effectively transport sheets containing holes adjacent to a marginal edge of the sheets. Removable port-closure members are inserted through the feeder ports which are aligned with the holes in the sheets to be transported by the feeder. The port-closure members may be formed, for example, of a resilient material configured, at least in part, to conform to the port to be closed. Illustratively, the port-closure member may be an open ring of spring material threadably inserted through the port to be blocked (i.e., the ports aligned with holes in the sheet as it is transported by the feeder). The diameter of the ring, in its free state, is sufficiently greater than the internal diameter of the feeder housing, taken at the port so that when the ring is positioned within the feeder, the ends of the ring overlap and exert an outward force on the feeder housing thereby securing the ring in the feeder while the ring blocks the selected port.

The invention and its objects and advantages, will become more apparent in the following detailed description of the preferred embodiment.

DESCRIPTION OF THE PREFERRED EMBODIMENT

As discussed above certain types of reproduction equipment use vacuum feeders for transporting discrete sheets seriatim from a supply along a travel path toward a printing station.

Sometimes it is desired to make reproductions on sheets having holes through the sheet surface, such as along a marginal edge. Examples of such sheets are 3-hole or 7-hole punched paper. When sheets with holes are to be fed, there is a possibility that one or more of the holes in the sheets may be aligned with ports in the feeder during transport. If a hole is aligned with a port, the tacking effect of the vacuum on the sheet is impaired. That is to say, the vacuum will be lost through the hole in the sheet, or when feeding from a stack of sheets a subsequent sheet may be drawn into tacked engagement with the sheet being fed. In either case, the overall effect is to interfere with the normal feed operation.

This invention overcomes the transport difficulties caused by the alignment of ports in the feeder with holes in the sheets. When it is determined that a particular port will be aligned with a hole in the sheet during transport, the port is closed by inserting a removable port-closure member through the port (from the outside of the feeder). The port-closure is configured to conform with the shape of the port for sealing the port without interfering with the normal operation of the feeder. Any suitable means, such as a conventional spring clip or wedged angagement between the closure member and the port, may be employed to retain the port-closure member in its port-sealing position, while permitting easy removal. Insertion of the port-closure through the port from the outside of the feeder (as opposed to internal valving within the feeder) is desireable since it enables an operator to readily close any port corresponding to the particular location of a hole in the sheets to be fed. Furthermore by making the port-closure easily removable, the sealed ports may be readily unblocked when the sheets to be fed do not have holes or when the holes are not aligned with feeder ports.

Figure 1:
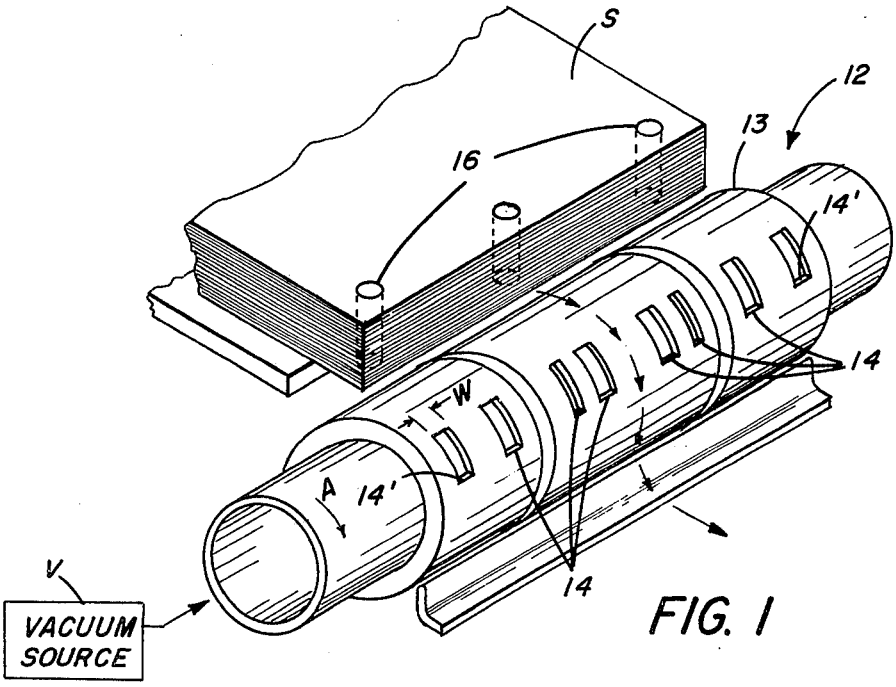
FIG. 1 is a perspective view of a vacuum feeder located relative to a stack of typical sheets of punched paper to be fed by the vacuum feeder.

One exemplary vacuum feeder which is used in transporting sheets seriatim from a supply along a travel path is shown in FIG. 1 of the drawings. The feeder 12 has a rotatable tubular vacuum housing 13 with a series of ports 14 and 14' through the housing wall. The ports are spaced in axial alignment transverse to the path of a sheet to be fed by the feeder. When the feeder 12 is rendered operative to transport sheets from a sheet supply stack S, a vacuum source V, coupled to the housing 13, is energized and the housing is rotated by drive means (not shown) so that the ports 14 and 14' are located adjacent to the stack. Since in this position the ports are fully covered by the first sheet, the sub-atmospheric condition created at the ports by the vacuum effectively tacks the sheet to the housing 13. Thus, when the feeder 12 is rotated (in the direction of arrow A) the sheet will be withdrawn from the supply and transported along the travel path. However, when sheets (see, for example, the 3-hole punched paper sheet stack S, illustrated in FIG. 1) are to be fed, holes 16 in the marginal edge of each sheet may be aligned with the outboard ports 14' in the feeder 12 during transport. In the event such alignment occurs, the effect of the vacuum may be lost through the aligned ports and sheet holes, or the vacuum may be effective through the holes to tack subsequent sheets to the sheet already tacked to the housing 13. The end result may be mis-feeding of the sheets or multiple sheet feeds.

Figure 2:
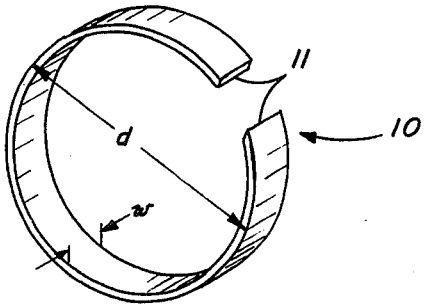
FIG. 2 is a perspective view of a port-closure which may be used with the vacuum feeder of FIG. 1.
Figure 3:
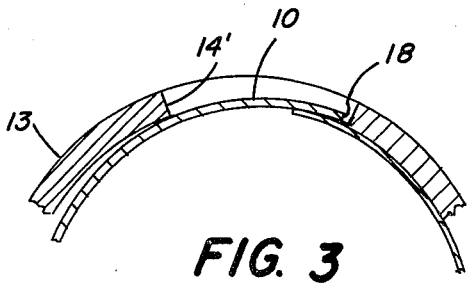
FIG. 3 is a fragmentary, cross-sectional view of the vacuum feeder of FIG. 1 taken through a closed port with the port-closure ring secured in place.

In order to prevent the feeding difficulties caused by the hole and port alignment, the ports 14' of the feeder 12 are blocked by appropriate port-closure members. One illustrative embodiment of a port-closure member according to this invention is depicted in FIG. 2 of the drawings. The port-closure member is a resilient open ring 10 shown in FIG. 2 in its free state. The ring, which is substantially circular in shape may be formed, for example, of metal or plastic. The ends of the resilient rings are spaced apart such that the ring may be compressed to a smaller overall diameter than it has when unconstrained. The dimensions of the ring 10 are selected on the basis of certain dimensions of the feeder 12. The general parameters which determine the dimensions of the ring 10 are the size of the ports to be blocked and the internal diameter of the feeder housing. That is to say, the ring is configured to have a width *w* substantially equal to the width W of the port through which it is to be threaded; and the diameter *d* of the ring in its free state is sufficiently larger than the internal diameter of the housing 13, taken at a section through the port to be blocked such that the ends of the ring will overlap when the ring is in position within the feeder housing. Thus, when the ring is threaded (pushed) through the port to be closed, the port is sealed to prevent the vacuum from being effective therethrough, and the ring is compressed to be securely constrained within the feeder at the location of the port.

As may be seen, the ring 10 is readily removable by prying up overlapping end 18 and reverse threading (pulling) the ring from the blocked port. The feeder 12 is thus returned to its stage where it is readily able to feed sheets without holes (or where the holes and ports are not aligned).

Alternatively the port-closure ring 10 could be formed as an elongate strip of resilient material. The strip may have a constant width substantially equal to the port to be blocked, or may have a portion configured to conform to the shape of the port. The strip is readily insertable through the port to be blocked (and removable from the port) in the same manner as discussed with regard to the ring 10. When the strip is inserted through the port, it is located so that at least the port-shaped portion is in position to seal the port to effect the desired closure thereof.

From the foregoing it is apparent that the described invention provides means for closing selected ports of a vacuum sheet feed apparatus to enable the apparatus to effectively feed sheets having holes through the sheet surface. Removable port-closure members are inserted through the feeder ports which are aligned with the holes in the sheets to be transported by the feeder. By closing the aligned ports, the negative effects on sheet transport resulting from alignment of the ports and the holes in the sheets (i.e., the impairment of sheet transport) will be prevented.

The invention has been described in detail with particular reference to preferred embodiments thereof, but it will be understood that variations and modifications can be effected within the spirit and scope of the invention.

I claim:

1. In a sheet feeding apparatus including a movable vacuum housing defining a plurality of ports which communicate with the interior of the housing for vacuum tacking sheets to the exterior of said housing during transport of such sheets seriatim along a transport path, means for insuring effective feeding of sheets having at least one hole therethrough, said means comprising:

an elongate resilient member insertable through any port in said housing which is aligned with any such hole during transport of such sheets for selectively closing such port, said member having a first portion which corresponds in size and shape to such port and a second portion spaced from said first portion for engaging the interior of said housing to urge said first portion into closing relationship with such port when said member is inserted through such port to be positioned within said housing.

2. In a sheet feeding apparatus including a movable substantially tubular vacuum housing defining a plurality of ports for vacuum tacking sheets to said housing during transport of such sheets seriatim along a path, means for insuring effective feeding of sheets having at least one hole therethrough, said means comprising:

an elongate member insertable through any port in said vacuum housing which is aligned with any such hole during transport of such sheets, said elongate member being formed of resilient material in the shape of an open ring of a width substantially equal to the width of the port through which it is to be inserted and of a diameter, in its free state, larger than the internal diameter of said housing taken through such port, whereby when the elongate member is inserted through such port, the port is closed.

3. The invention of claim 2 wherein the diameter of said open ring is of such a dimension that when said ring is positioned within said tubular housing the ends of said ring overlap to exert an outward pressure on said tubular housing to secure said ring therein.

* * * * *